US010577782B2

(12) United States Patent
Gao et al.

(10) Patent No.: US 10,577,782 B2
(45) Date of Patent: Mar. 3, 2020

(54) DEVICE INTEGRATED HOT AND COLD TAP WATER AND HOT AND COLD PURIFIED WATER

(71) Applicant: Guangzhou Seagull Kitchen and Bath Products Co., Ltd., Guangdong (CN)

(72) Inventors: Shuqi Gao, Guangdong (CN); Qianfeng Peng, Guangdong (CN); Rongbao Wei, Guangdong (CN); Fu Luo, Guangdong (CN)

(73) Assignee: Guangzhou Seagull Kitchen and Bath Products Co., Ltd., Guangdong (CN)

( * ) Notice: Subject to any disclaimer, the term of this patent is extended or adjusted under 35 U.S.C. 154(b) by 0 days.

(21) Appl. No.: 15/941,004

(22) Filed: Mar. 30, 2018

(65) Prior Publication Data

US 2019/0234055 A1 Aug. 1, 2019

(30) Foreign Application Priority Data

Jan. 31, 2018 (CN) ..... 2018 1 0094557
Jan. 31, 2018 (CN) ..... 2018 2 0165038 U

(51) Int. Cl.
*E03C 1/04* (2006.01)
*E03C 1/23* (2006.01)

(52) U.S. Cl.
CPC .... *E03C 1/0404* (2013.01); *E03C 2001/2311* (2013.01); *E03C 2201/40* (2013.01)

(58) Field of Classification Search
CPC ..... B05B 12/004–008; B05B 12/085–088; B05B 12/1472; E03B 1/04–048; E03C 1/025; E03C 1/04; E03C 1/0403–0407; E03C 1/05–057; E03C 1/06–066; E03C 2001/0415–0417; Y10T 137/9464
See application file for complete search history.

(56) References Cited

U.S. PATENT DOCUMENTS 4,162,218 A * 7/1979 McCormick ..... C02F 1/006 210/104
4,922,943 A * 5/1990 Gill ..... E03B 1/048 137/1
5,819,773 A * 10/1998 Kronowitt ..... E03B 11/02 137/1
6,029,699 A * 2/2000 Granot ..... E03C 1/04 137/565.12

(Continued)

*Primary Examiner* — Lauren A Crane
*Assistant Examiner* — Nicholas A Ros
(74) *Attorney, Agent, or Firm* — JCIPRNET

(57) ABSTRACT

A device integrated hot and cold tap water and hot and cold purified water including a casing pipe, a water guide mechanism, a touch switch, a microcontroller, a pulling head, and first and second magnetic components is provided. The water guide mechanism includes first and second pipelines disposed in the casing pipe. The first and second pipe lines are respectively provided with a first valve body and a touch control assembly. The touch switch and the microcontroller are electrically connected with the touch control assembly. The pulling head includes a fixed cylinder provided in a water outlet of the casing pipe and a bubble former fixed in the fixed cylinder. An interior of the bubble former has an inner waterway and an outer waterway. The first and second pipelines communicate with the water outlet of the casing pipe through the outer waterway and one end of the inner waterway, respectively.

11 Claims, 7 Drawing Sheets

(56) References Cited

U.S. PATENT DOCUMENTS

| | | | | |
|---|---|---|---|---|
| 6,250,338 | B1 * | 6/2001 | Dempsey | E03C 1/04 137/801 |
| 8,876,012 | B2 * | 11/2014 | McMurtry | E03B 1/048 236/12.13 |
| 10,066,375 | B2 * | 9/2018 | Kostorz | E03C 1/0403 |
| 2005/0205680 | A1 * | 9/2005 | Valente | E03B 1/048 236/12.11 |
| 2007/0235091 | A1 * | 10/2007 | Granot | E03C 1/0404 137/597 |
| 2008/0011378 | A1 * | 1/2008 | Fath | C02F 1/50 138/137 |
| 2012/0067437 | A1 * | 3/2012 | Xia | E03C 1/0404 137/317 |
| 2012/0312401 | A1 * | 12/2012 | Gioira | F16L 41/023 137/603 |
| 2014/0352799 | A1 * | 12/2014 | Rosko | C02F 1/78 137/237 |

* cited by examiner

DEVICE INTEGRATED HOT AND COLD TAP WATER AND HOT AND COLD PURIFIED WATER

CROSS-REFERENCE TO RELATED APPLICATION

This application claims the priority benefit of China application serial no. 201810094557.4, filed on Jan. 31, 2018, and China application serial no. 201820165038.8, filed on Jan. 31, 2018. The entirety of each of the above-mentioned patent applications is hereby incorporated by reference herein and made a part of specification.

BACKGROUND

Technical Field of the Present Invention

The present invention relates to the fields of faucet, in particular to a device integrated hot and cold tap water and hot and cold purified water.

Technical Background of the Present Invention

At present, commonly used pulling-type faucet and water purifier faucet are separate. Countertop should be provided with two mounting holes, one hole is used to install the pulling-type faucet; and the other hole is used to install the water purifier faucet, so the countertop needs large space, and looks messy, which affects beauty of the countertop.

Such techniques have the following drawbacks:

1. In order to install two faucets (that is, the pulling-type faucet and the water purifier faucet), a user needs to add a mounting hole for a sink (or countertop). Such sink (or countertop) needs special customization, and has poor universality;
2. The countertop needs two mounting holes, and the countertop needs large space;
3. The countertop is added more faucet, and looks messy, which affects beauty of the countertop.

SUMMARY OF THE INVENTION

A purpose of the present invention is to solve at least above problems and to provide at least advantages that will be described later.

Another purpose of the present invention is to provide an integrated water outlet pipe which can integrate a first pipeline and a second pipeline into a casing pipe for the purpose of allowing one outlet pipe to flow out of tap water and purified water respectively.

The present invention also provides a pulling-type faucet, which can be installed on a countertop with only one mounting hole, has good versatility, do not need to customize the countertop with two mounting holes, and has the role of simplifying the countertop.

The present invention also provides a device integrated hot and cold tap water and hot and cold purified water, which has a function of flowing cold or hot tap water, cold or hot purified water from the same pulling head.

In view of purposes mentioned above and other advantages, the present invention provides an integrated water outlet pipe, comprising: a casing pipe; a water guide mechanism including a first pipeline and a second pipeline disposed in the casing pipe, and the first pipeline and the second pipeline being not communicated with each other, and the first pipeline and one end of the second pipeline being in communication with the water outlet of the casing pipe, and the other end of the second pipeline being in communication with a tap water supply part and a purified water supply part respectively, the first pipeline and the second pipeline being respectively provided with a first valve body and a touch control assembly.

The present invention also provides a pulling-type faucet, which includes the integrated water outlet pipe in the above technical solution, and further comprises a pulling head comprising a fixed cylinder provided in the water outlet of the casing pipe and a bubble former fixed in the fixed cylinder, the interior of the bubble former having an inner waterway and an outer waterway sleeved outside the inner waterway, and the inner waterway being not communicated with the outer waterway, the inner waterway and one end of the outer waterway being communicated with the water outlet of the casing pipe.

Wherein the first pipeline and the second pipeline communicate with the water outlet respectively through the outer waterway and one end of the inner waterway, and the first pipeline and the second pipeline extending out of the water outlet of the casing pipe along the downstream end of the water flow direction when the fixed cylinder is pulled out of the casing pipe.

Preferably, the outer diameter of the downstream end of the fixed cylinder along the water flow direction is not smaller than the outer diameter of the water outlet, and the inner diameter is smaller than the inner diameter of the water outlet.

Preferably, the fixed cylinder, the inner waterway, and the outer waterway are coaxially arranged, and one end of the second pipeline penetrates into the first pipeline and communicates with the inner waterway.

The present invention also provides a device integrated hot and cold tap water and hot and cold purified water, which comprises the pulling-type faucet in the above technical solution; the first valve body being a mixing valve; the first pipeline comprising: a first water inlet hose having one end communicated with a cold water supply part of the tap water supply part and the other end communicated with the water inlet end of the first valve body; a second water inlet hose having one end communicated with the hot water supply part of the tap water supply part and the other end communicated with the water inlet end of the first valve body; a connecting pipe having one end communicated with the water outlet end of the first valve body and the other end communicated with the outer waterway; the second pipeline being a flexible pipe, one end of which is provided with two branch pipes, and the other end of which penetrates into the connecting pipe and communicates with the inner waterway; the two branch pipes being respectively connected with the hot water supply part and cold water supply part of the purified water supply part, two branch pipes being provided with a hot water valve and a cold water valve.

Preferably, the hot water valve and the cold water valve are electromagnetic valves; the pulling type faucet device also comprising: a touch switch electrically connected with the touch control assembly; a microcontroller electrically connected with the touch control assembly, the touch switch, the hot water valve, and the cold water valve; wherein the microcontroller controls the touch control assembly and the cold water valve to be opened when the touch control assembly and the cold water valve are in a close state and the touch switch receives a first switch signal and transmits to the microcontroller; the microcontroller controlling the touch control assembly and the cold water valve to be closed when the touch control assembly and the cold water valve are in an open state and the touch switch receives the first switch signal and transmits to the microcontroller; the microcontroller controlling the touch control assembly and the hot water valve to be opened when the-touch control assembly and the hot water valve are in a close state and the touch switch receives a second switch signal and transmits to the microcontroller; the microcontroller controlling the touch control assembly and the hot water valve to be closed when the touch control assembly and the hot water valve are in an open state and the touch switch receives the first switch signal and transmits to the microcontroller.

Preferably, the device integrated hot and cold tap water and hot and cold purified water also comprises a first magnetic component and a second magnetic component.

The first magnetic component comprising: a spring installed inside of the connecting pipe along the water flow direction and located outside of the second pipeline and fixed along the downstream end of the water flow direction; a magnet fixed to the upstream end of the spring along the water flow direction, the magnet being located inside of the connecting pipe and located outside of the second pipeline; a first magnetic probe fixed outside of the connecting pipe and located at the upstream position of the magnet along the water flow direction to detect a magnetic force signal of the magnet, the first magnetic probe being electrically connected with the microcontroller; the second magnetic component comprising: a soft magnet wrapped on an outer wall of the connecting pipe; a second magnetic probe disposed on the inner wall of the casing pipe and located at an upstream position of the soft magnet along the water flow direction to detect a magnetic force signal of the soft magnet and the second magnetic probe being electrically connected with the microcontroller.

When the first valve body is closed and the fixed cylinder is not drawn out, the spring naturally expanding, the magnet being located closest to the first magnetic probe, and the first magnetic probe detecting a first magnetic signal and transmitting to the microcontroller, the soft magnet being located at an initial position, the second magnetic probe detecting a second magnetic signal and transmitting the second magnetic signal to the microcontroller, and the microcontroller simultaneously receiving the first magnetic signal and the second magnetic signal, the microcontroller controlling the touch switch to transmit the first switch signal or the second switch signal, and the touch control assembly capable of turning on or off.

When the first valve body is closed and the fixed cylinder is drawn out, the spring naturally expanding, the magnet being located closest to the first magnetic probe, and the first magnetic probe detecting the first magnetic signal and transmitting to the microcontroller, the soft magnet being located far away from the initial position, the second magnetic probe detecting a third magnetic signal and transmitting the third magnetic signal to the microcontroller, and the microcontroller simultaneously receiving the first magnetic signal and the third magnetic signal, the microcontroller controlling the touch switch to not transmit the first switch signal and the second switch signal, and the touch control assembly being normally closed.

When the mixing valve is opened and the fixed cylinder is not drawn out, the spring being compressed, the magnet being located away from the first magnetic probe, and the first magnetic probe detecting a fourth magnetic signal and transmitting to the microcontroller, the soft magnet being located the initial position, the second magnetic probe detecting the second magnetic signal and transmitting to the microcontroller, and the microcontroller simultaneously receiving the fourth magnetic signal and the second magnetic signal, the microcontroller controlling the touch switch to not transmit the first switch signal and the second switch signal, and the touch control assembly being normally closed.

When the mixing valve is opened and the fixed cylinder is drawn out, the spring being compressed, the magnet being located away from the first magnetic probe, and the first magnetic probe detecting the fourth magnetic signal and transmitting to the microcontroller, the soft magnet being located away from the initial position, the second magnetic probe detecting the third magnetic signal and transmitting to the microcontroller, and the microcontroller simultaneously receiving the fourth magnetic signal and the third magnetic signal, the microcontroller controlling the touch switch to not transmit the first switch signal and the second switch signal, and the touch control assembly being normally closed.

Preferably, the second pipeline is a silicone pipe.

Preferably, the outer wall of the upstream end of the connecting pipe along the water flow direction is provided with a counterweight.

Preferably, the casing pipe is a bending pipe.

Preferably, the device integrated hot and cold tap water and hot and cold purified water also comprises a water saving mechanism, comprising: a first electric valve provided on the connecting pipe; an intercepting pipe, one end of which is inserted into the outer wall of the connecting pipe and communicated with the connecting pipe, and the intercepting pipe being provided with a second electric valve; a water collecting tank with a top communicating with the other end of the intercepting pipe; a water outlet pipe body, one end of which is communicated with the bottom of the water collecting tank, and the other end of which is inserted into the outer wall of the first water inlet hose and communicated with the first water inlet hose, and the water outlet pipe body being provided with a third electric valve; a fourth electric valve disposed on the first water inlet hose and located at the upstream position of communicating place of the water outlet pipe body and the first water inlet hose along the water flow direction; a temperature sensor disposed on the connecting pipe to detect the water temperature in the connecting pipe; a water level sensor disposed on the water collecting tank to detect the water level in the water collecting tank.

Wherein the temperature sensor, the water level sensor, the first electric valve, the second electric valve, the third electric valve, and the fourth electric valve are all electrically connected with the microcontroller.

The water level sensor detecting the water level in the water collecting tank at a preset frequency, and if the water level is lower than a first water level threshold, the microcontroller controlling to turn off the third electric valve and simultaneously turn on the fourth electric valve, if the water level is higher than a second water level threshold, the microcontroller controlling to turn on the third electric valve while turning off the fourth electric valve, wherein the first water level threshold is smaller than the second water level threshold.

When the first valve body is opened, the microcontroller controlling the temperature sensor to detect the water temperature in the connecting pipe at a preset frequency, and when the water temperature is higher than a preset temperature threshold, the microcontroller controlling to turn on the first electric valve while turning off the second electric valve.

When the first valve body is closed, the microcontroller controlling the temperature sensor and the water level sensor to stop detecting while turning off the first electric valve and turning on the second electric valve.

Preferably, the preset frequency of the water level sensor for detecting the water level is 10 times/min.

Preferably, the preset frequency of the temperature sensor for detecting the water temperature is 30 times/min.

Preferably, the preset temperature threshold is set to 42 degrees Celsius.

Preferably, the water collecting tank is transparent, the side wall of the water collecting tank is provided with a scale, and the volume of the water collecting tank is 5 L.

The present invention includes at least the following advantages:

First, the commonly used pulling-type tap water faucet and purified water faucet are separate. Countertop should be provided with two mounting holes, one hole is used to install the pulling-type faucet; and the other hole is used to install the water purifier faucet, so that the countertop needs a large space, and looks messy, which affects beauty of the countertop, using the first pipeline and the second pipeline integrated into the casing pipe, so the countertop only needs to set up a mounting hole, capable of collecting tap water and purified water, saving space of the countertop, making the countertop more clean and more beautiful.

Second, in the prior art, the function of the bubble former is to relieve the impact of the water flow so as to reduce the water splashing to the surroundings. However, the bubble former usually has only one water outlet channel. When the tap water and purified water share a bubble former, which will result in purified water pollution. If you abandon the first collected purified water, which will result in the waste of purified water, providing bubble former with inner waterway and outer waterway in the water outlet of the casing pipe, the inner waterway and the outer waterway being not communicated to prevent the purified water from being polluted, saving purified water, and relieving the impact of the water flow; the fixed cylinder being pulled out from the water outlet of the casing pipe to drive the bubble former away from the water outlet of the casing pipe to drive the first pipeline and the second pipeline out of the water outlet of the casing pipe to achieve pulling function, easy collecting water.

Third, if you need to use of cold, warm, or hot tap water, or cold, hot purified water. In the above technical solution, the switch of the tap water is set as a mixing valve, and at the same time, communicating with the hot water supply part and the cold water supply part of the tap water so as to adjust the mixing valve to adjust the water temperature of the tap water.

Opening the hot water valve, closing the cold water valve, then opening the touch control assembly, you can collect the hot purified water. Closing the hot water valve, opening the cold water valve, then opening the touch control assembly, you can collect cold purified water.

Fourth, the touch control assembly is configured as a solenoid valve and is electrically connected with the touch switch. When the touch control assembly is in the closed state, the cold water valve and the touch control assembly can be opened by touching the touch switch by hand at a moment, cold purified water flows out. When the control assembly is in the open state, the cold water valve and the solenoid valve can be turned off by touching the touch switch by hand at a moment; pressing the touch switch with your hand, capable of opening the hot water valve and the control assembly, hot purified water flowing out, then the hand touching the touch switch to close the hot water valve and the touch control assembly capable of easily controlling on or off of purified water, and collecting cold or hot purified water more convenient.

Fifth, in the course of using, when tap water is turned on or the pulling head is pulled out, the touch switch is inadvertently pressed and the hot purified water flows out to easily burn the user. The first magnetic component and the second magnetic component are used, as long as the first valve body is open, or as long as the fixed cylinder is pulled out, the purified water switches are closed and can not be opened, thereby achieving the purpose of preventing burns.

Sixth, if the hot water supply part of the tap water supply part is farther away from the water outlet of the casing pipe in the course of use, it will need to pass through a longer pipeline to reach the water outlet of the casing pipe, thus requiring to collect a large quantity of cold tap water in the first pipeline in order to receive hot tap water. It will waste a lot of tap water resources. In the above technical solution, the cold tap water in the first pipeline is introduced into the collecting tank for temporarily storing through the intercepting pipe. When the cold tap water is completely intercepted, stopping intercepting, so that the water from the water outlet pipe of the casing pipe is hot.

When the amount of tap water in the water collecting tank reaches a certain amount, cold tap water needs to be used, flowing back to the first pipeline through the water outlet pipe body, and then flowing out from the water outlet of the casing pipe to achieve the purpose of saving water.

Other advantages, objects, and features of the present invention will be showed in part through following description, and in part will be understood by those skilled in the art from study and practice of the present invention.

DETAILED DESCRIPTION

Figure 1:
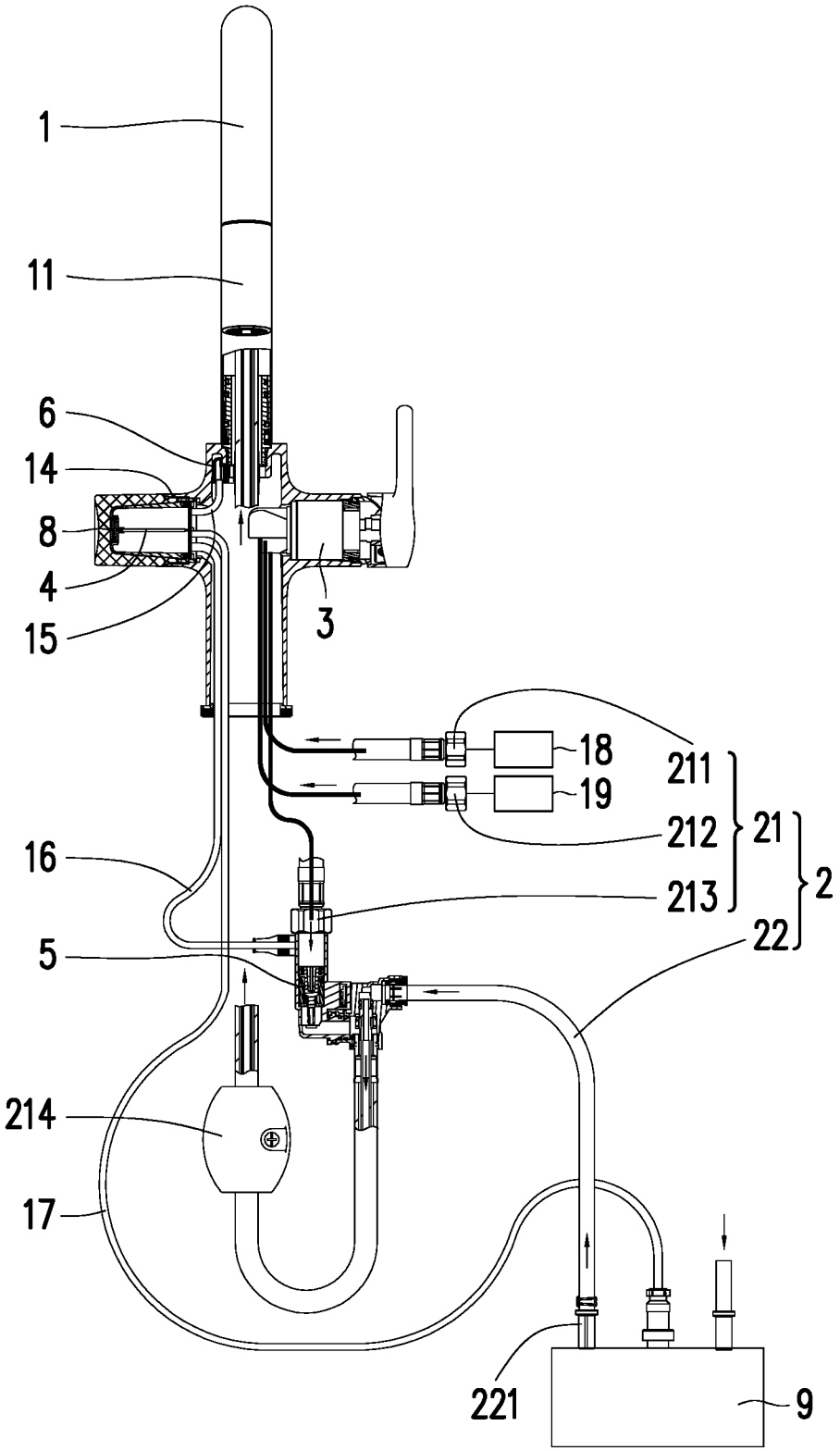
FIG. 1 is a structural view of the overall structure of the present invention.

The present invention will now be described in further detail with reference to the accompanying drawings in order to enable person skilled in the art to practice with reference to the description.

It should be noted that in the description of the present invention, the terms of "up", "down", "upstream", "downstream", "inner", "outer" and the like are based on the orientation or positional relationship shown in the drawings for convenience of describing the present invention and simplifying description. It is not intended or implied that the device or element must have a particular orientation and be constructed and operated in a particular orientation, and therefore it should not be construed as limiting the present invention.

Figure 2:
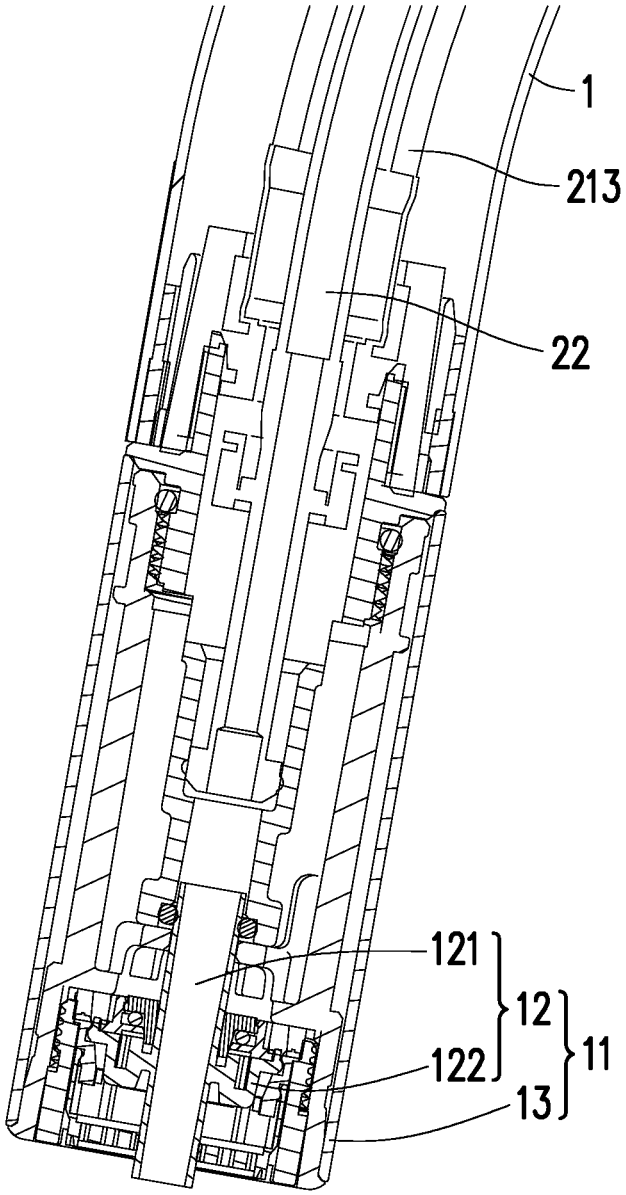
FIG. 2 is a detail view of the casing and the bubble former of the present invention.
Figure 3:
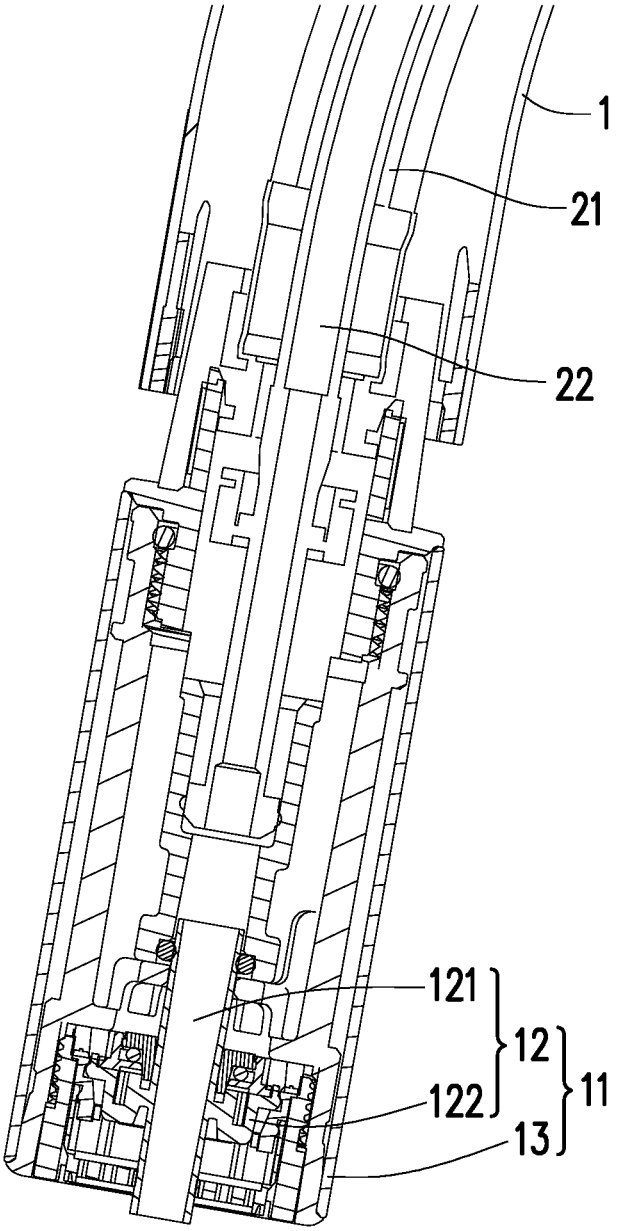
FIG. 3 is a detail view when the pulling head is pulled out of the present invention.
Figure 4:
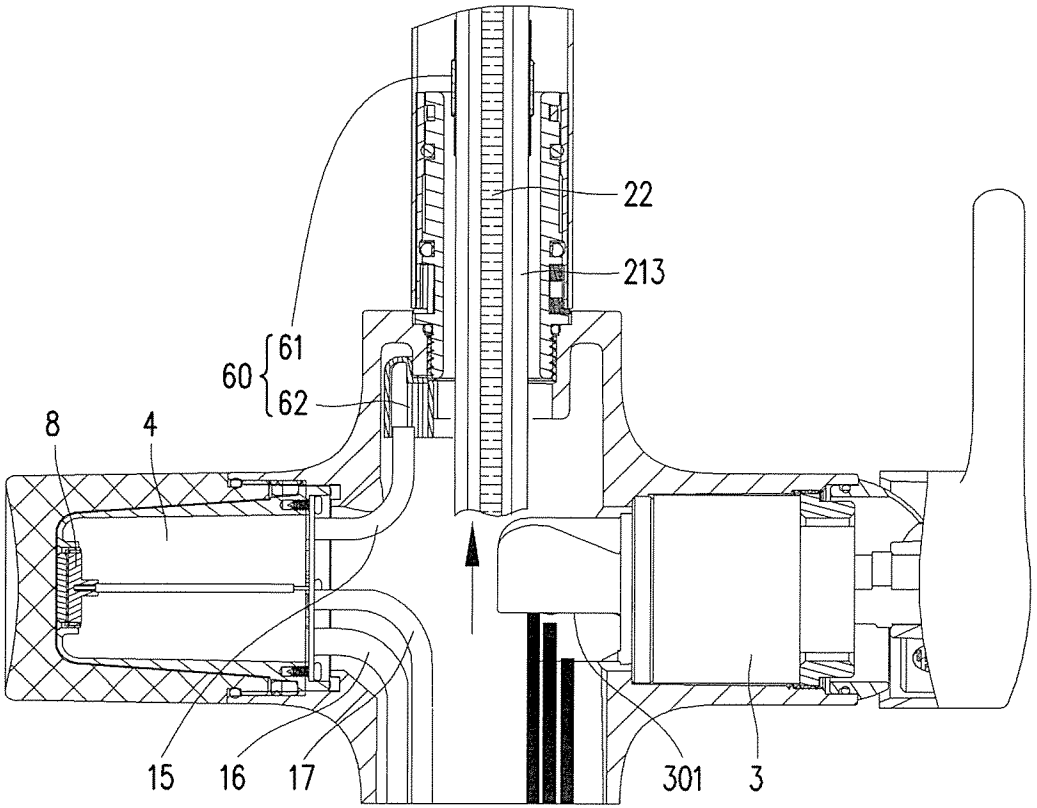
FIG. 4 is a detail view of the second magnetic component of the present invention.
Figure 5:
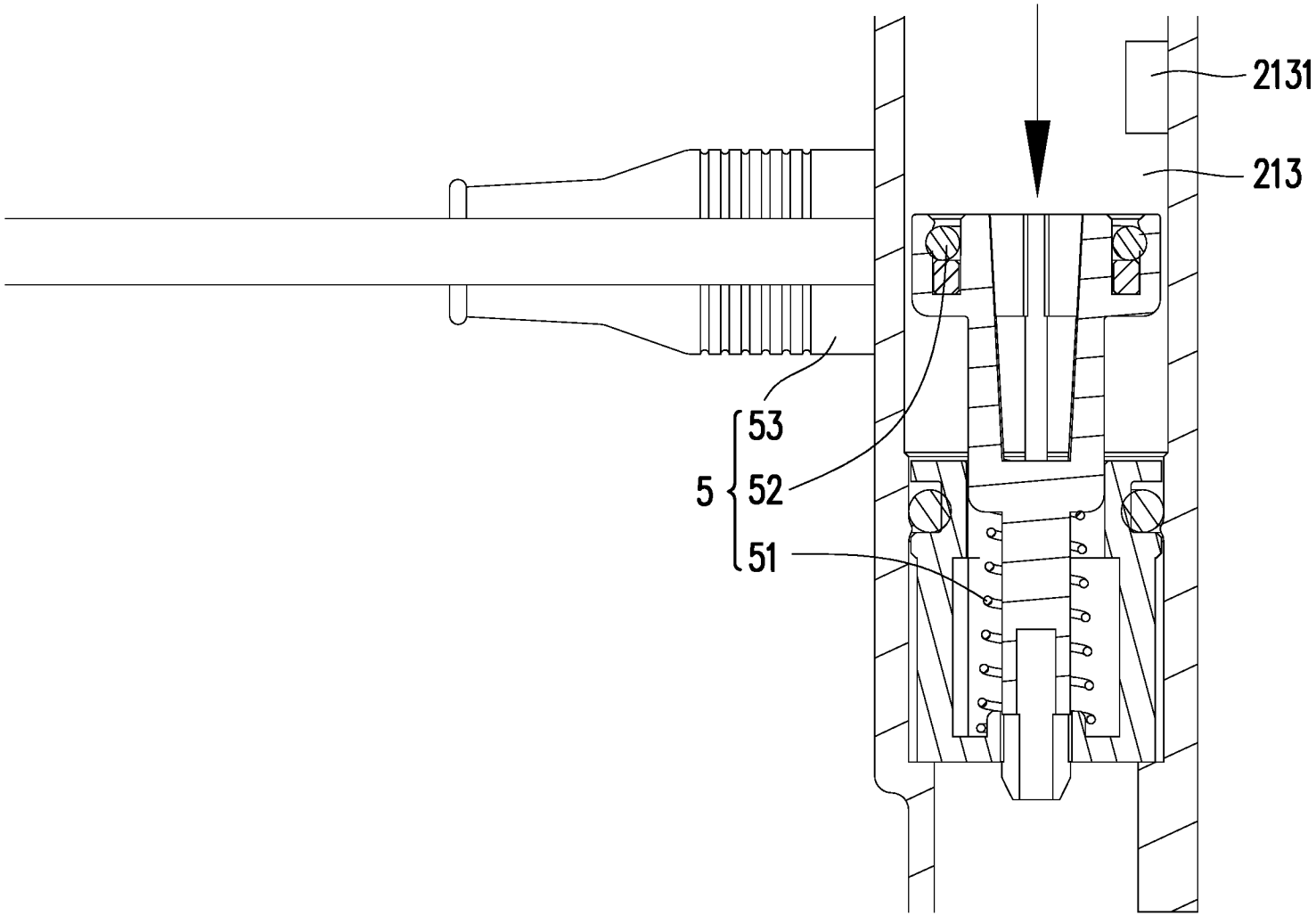
FIG. 5 is a state view of the first magnetic component when the first valve body is closed of the present invention.
Figure 6:
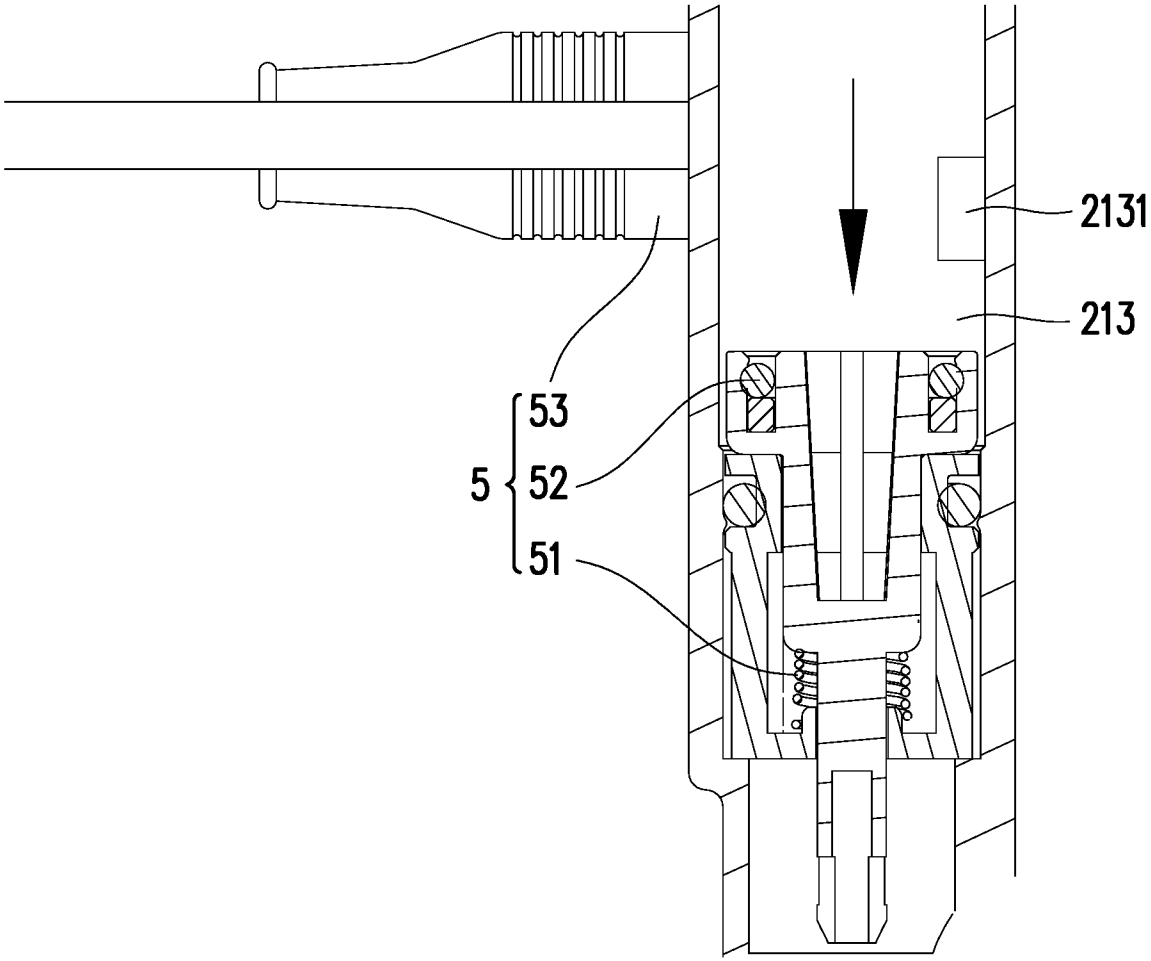
FIG. 6 is a state view of the first magnetic component when the first valve body is opened of the present invention.
Figure 7:
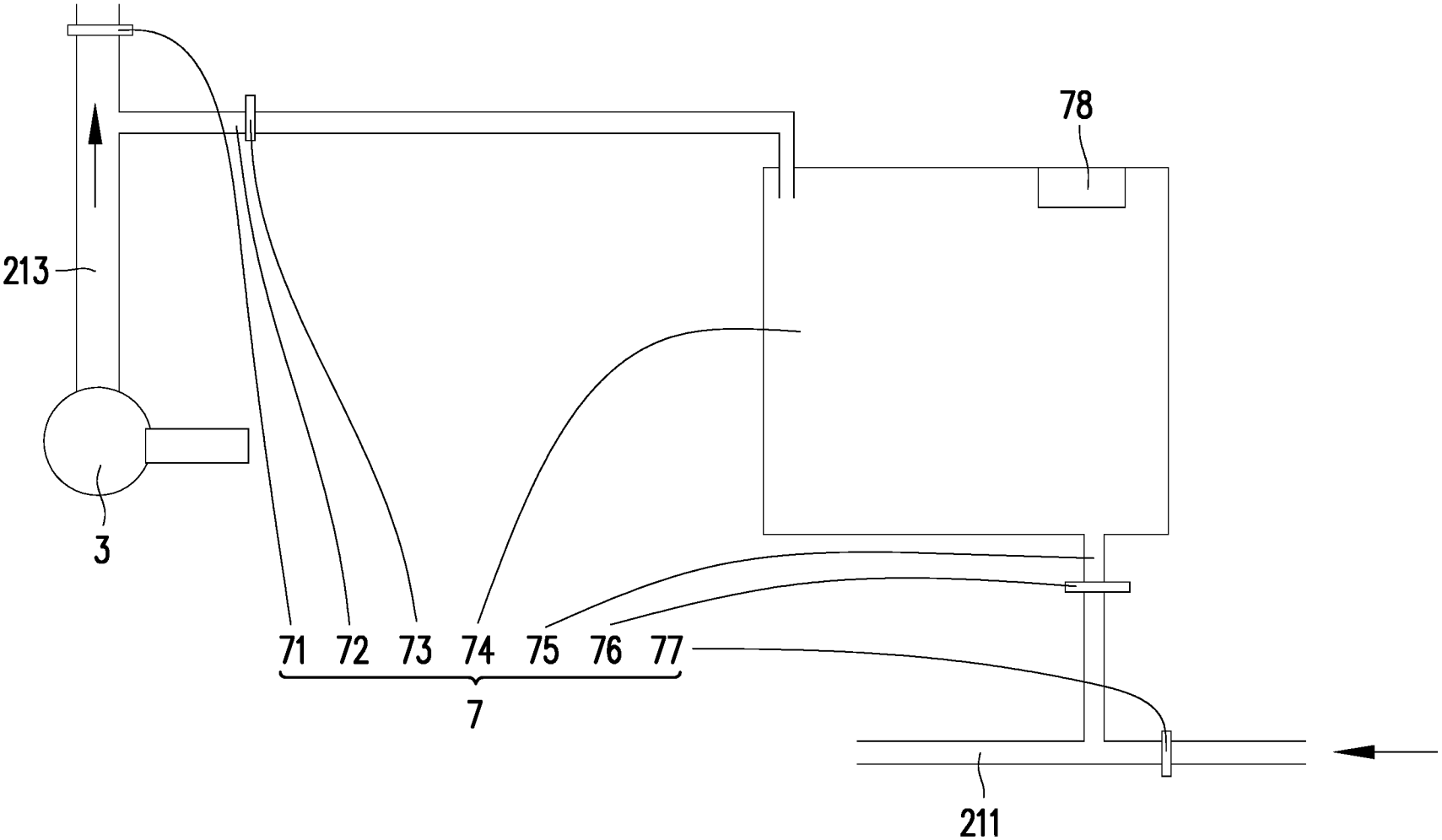
FIG. 7 is a structural view of the water saving mechanism of the present invention.

As shown in FIG. 1 to FIG. 7, the present invention provides an integrated water outlet pipe, comprising: a casing pipe 1, which may be a bending pipe, a straight pipe, a flexible pipe, a rigid pipe or the like, which is not limited in the present technical solution and needs to form a vacant space in the interior thereof; a water guide mechanism 2 including a first pipeline 21 and a second pipeline 22 disposed in the casing pipe 1, the first pipeline 21 and the second pipeline 22 capable of fixing in the casing pipe 1 or moving relative to the casing pipe 1, only the first pipeline 21 and the second pipeline 22 need to pass through the casing pipe 1, and the first pipeline 21 having one end in communication with the water outlet of the casing pipe 1 and an opposing end in communication with a tap water supply part (cold tap water supply part 18 and hot tap water supply part 19), the second pipeline 22 having one end in communication with the water outlet of the casing pipe 1 and an opposing end in communication with a purified water supply part 9 respectively, the first pipeline 21 and the second pipeline 22 being respectively provided with a first valve body 3 and a touch control assembly 4. Whether the first valve body 3 and the touch control assembly 4 are passed through the casing pipe 1 is not limited by the present technical solution as long as the first valve body 3 and the touch control assembly 4 can respectively block or communicate the first pipeline 21 and the second pipeline 22.

In the above technical solution, the casing pipe 1 can be installed on the bathroom. Opening the first valve body 3, the tap water can flow out of the water outlet of the casing pipe 1 through the first pipeline 21. Opening the touch control assembly 4, the purified water can flow out of the water outlet of the casing pipe 1 through the second pipe 22, thus integrating the tap water and purified water into the casing pipe 1 to form an integrated water outlet pipe. When it is required to install a tap water and a purified water outlet pipe at the same time. It is only required to provide a mounting hole on the countertop or wall, so you can save space of the countertop or wall, and the countertop or wall does not look messy, so the countertop or wall is more beautiful.

The present invention also provides a pulling-type faucet, which includes the integrated water outlet pipe in the above technical solution, and further comprises a pulling head 11 comprising a fixed cylinder 13 provided in the water outlet of the casing pipe 1 and a bubble former 12 fixed in the fixed cylinder 13, the interior of the bubble former 12 having an inner waterway 121 and an outer waterway 122 sleeved outside the inner waterway 121, and the inner waterway 121 being not communicated with the outer waterway 122, the inner waterway 121 and one end of the outer waterway 122 being communicated with the water outlet of the casing pipe 1. Shape, length of the inner waterway 121 and the outer waterway 122, whether the end of the water outlet is inserted into the water outlet of the casing pipe 1 or located within the casing pipe 1 are not limited in the technical solution of, which only need to be able to respectively communicate with the water outlet of the casing pipe 1.

Wherein the first pipeline 21 and the second pipeline 22 communicate with the water outlet respectively through the outer waterway 122 and one end of the inner waterway 121, and the first pipeline 21 and the second pipeline 22 extend out of the water outlet of the casing pipe 1 along the downstream end of water flow direction when the fixed cylinder 13 is pulled out of the casing pipe 1.

The commonly used pulling-type tap water faucet and purified water faucet are separate. The countertop should be provided with two mounting holes, one hole is used to install the pulling-type faucet; and the other hole is used to install the water purifier faucet, so that the countertop needs a large space, and looks messy, which affects beauty of the countertop, in the above technical solution, using the first pipeline 21 and the second pipeline 22 integrated into the pulling-type faucet, so the countertop only needs to set up a mounting hole, capable of collecting tap water and purified water.

Further, in the prior art, the function of the bubble former is to relieve the impact of the water flow so as to reduce the water splashing to the surroundings. However, the bubble former usually has only one water outlet channel. When the tap water and purified water share a bubble former 12, which will result in purified water pollution. If you abandon the first collected purified water, which will result in the waste of purified water, providing bubble former 12 with inner waterway 121 and outer waterway 122 in the water outlet of the casing pipe 1, the inner waterway 121 and the outer waterway 122 being not communicated to prevent the purified water from being polluted, saving purified water, and relieving the impact of water flow; the fixed cylinder 13 being pulled out from the water outlet of the casing pipe 1 to drive the bubble former 12 away from the water outlet of the casing pipe 1 to drive the first pipeline 21 and the second pipeline 22 out of the water outlet of the casing pipe to achieve pulling function, easy collecting water.

In another technical solution, the outer diameter of the fixed cylinder 13 along the downstream end of water flow direction is not smaller than the outer diameter of the water outlet, and the inner diameter is smaller than the inner diameter of the water outlet, which is prevented the fixed cylinder 13 along the downstream end of water flow direction from being caught in the inside of the casing pipe 1 and is difficult to be pulled out.

In another technical solution, the fixed cylinder 13, the inner waterway 121, and the outer waterway 122 are coaxially arranged, and one end of the second pipeline 22 penetrates into the first pipeline 21 and communicates with the inner waterway 121, so that the tap water and the purified water flows all out as the center of the axis center of the fixed cylinder 13, which is more in line with the user's anticipation of the position of the outgoing water when the tap water or purified water is turned on.

The present invention also provides a device integrated hot and cold tap water and hot and cold purified water, which comprises the pulling-type faucet in the above technical solution; the first valve body 3 being a mixing valve; the mixing valve being a commonly used mechanical valve, generally speaking, having two water inlet ends, one water outlet end, one handle, a ceramic piece connected with the handle, and a valve body base, the ceramic piece capable of being replaced by other mechanical structures, when the handle is turned, the ceramic piece capable of being driven to rotate so as to adjust the flow rate of the two water inlet ends into the valve body base, and then flowing out from the water outlet end to mix the water entering from the two water inlet ends.

The first pipeline 21 comprises: a first water inlet hose 211 having one end communicated to a cold water supply part 18 of the tap water supply part and the other end communicated with the water inlet end 301 of the first valve body 3; a second water inlet hose 212 having one end communicated with the hot water supply part 19 of the tap water supply part and the other end communicated with the water inlet end 301 of the first valve body 3; a connecting pipe 213 having one end communicated with the water outlet end of the first valve body 3 and the other end communicated with the outer waterway 122; the second pipeline 22 being a flexible pipe, one end of which is provided with two branch pipes 221, and the other end of which penetrates into the connecting pipe 213 and communicates with the inner waterway 121; the two branch pipes 221 being respectively communicated with a hot water supply part 901 and a cold water supply part 902 of the purified water supply part 9, the two branch pipes 221 being provided with a hot water valve 223 and a cold water valve 224, as shown in FIG. 8.

In the process of use, if you need to use of cold, warm, or hot tap water, or cold, hot purified water. In the above technical solution, the switch of the tap water is set as a mixing valve, and at the same time, communicating with the hot water supply part and the cold water supply part of the tap water so as to adjust the mixing valve to adjust the water temperature of the tap water.

Opening the hot water valve 223, closing the cold water valve 224, then opening the touch control assembly 4, you can collect the hot purified water. Closing the hot water valve 223, opening the cold water valve 224, then opening the touch control assembly 4, you can collect cold purified water.

In another technical solution, the hot water valve 223 and the cold water valve 224 are electromagnetic valves; the pulling type faucet device also comprising: a touch switch 8 electrically connected with the touch control assembly 4; a microcontroller 14 electrically connected with the touch control assembly 4, the touch switch 8, the hot water valve 223, and the cold water valve 224.

Wherein the microcontroller 14 controls the touch control assembly 4 and the cold water valve 224 to be opened when the touch control assembly 4 and the cold water valve 224 are in a close state and the touch switch 8 receives a first switch signal and transmits to the microcontroller 14.

The microcontroller controlling the touch control assembly 4 and the cold water valve 224 to be closed when the touch control assembly 4 and the cold water valve 224 are in an open state and the touch switch 8 receives the first switch signal and transmits to the microcontroller 14.

The microcontroller 14 controlling the touch control assembly 4 and the hot water valve 223 to be opened when the touch control assembly 4 and the hot water valve 223 are in a close state and the touch switch 8 receives a second switch signal and transmits to the micro controller 14.

The microcontroller 14 controlling the touch control assembly 4 and the hot water valve 223 to be closed when the touch control assembly 4 and the hot water valve 223 are in an open state and the touch switch 8 receives the first switch signal and transmits to the microcontroller 14.

In the above technical solution, the touch control assembly 4 is configured as a solenoid valve and is electrically connected with the touch switch 8. When the touch control assembly 4 is in the closed state, the cold water valve 224 and the touch control assembly 4 can be opened by touching the touch switch by hand at a moment, and cold purified water flows out. When the touch control assembly 4 is in the open state, the cold water valve 224 and the solenoid valve can be turned off by touching the touch switch 8 by hand at a moment; pressing the touch switch 8 with your hand, capable of opening the hot water valve 223 and the touch control assembly 4, hot purified water flowing out, then the hand touching the touch switch 8 to close the hot water valve 223 and the touch control assembly 4 capable of easily controlling on or off of purified water, and collecting cold or hot purified water more conveniently.

In another technical solution, the device integrated hot and cold tap water and hot and cold purified water also comprises a first magnetic component 5 and a second magnetic component 6; the first magnetic component 5 comprising: a spring 51 installed inside of the connecting pipe 213 along the water flow direction and located outside of the second pipeline 22 and fixed along the downstream end of the water flow direction; a magnet 52 fixed to the upstream end of the spring 51 along the water flow direction, the magnet 52 being located inside of the connecting pipe 213 and located outside of the second pipeline 22; a first magnetic probe 53 fixed outside of the connecting pipe 213 and located at the upstream position of the magnet 52 along the water flow direction to detect a magnetic force signal of the magnet 52, the first magnetic probe 53 being electrically connected with the microcontroller 14, wherein data lines 15, 16 and 17 are used for connecting the second magnetic component 6, the first magnetic component 5 and a purified water supply part 9 with the microcontroller 14, respectively.

The second magnetic component 6 comprises: a soft magnet 61 wrapped on an outer wall of the connecting pipe 213; a second magnetic probe 62 disposed on an inner wall of the casing pipe 1 and located at the upstream position of the soft magnet 61 along the water flow direction to detect a magnetic force signal of the soft magnet 61 and the second magnetic probe 62 being electrically connected with the microcontroller 14.

Wherein when the first valve body 3 is closed and the fixed cylinder 13 is not drawn out, the tap water located in the connecting pipe 213 being in a static state, the spring 51 naturally expanding, the magnet 52 being located closest to the first magnetic probe 53, and the first magnetic probe 53 detecting a first magnetic signal and transmitting to the microcontroller 14, the soft magnet 61 being located at an initial position, the second magnetic probe 62 detecting a second magnetic signal and transmitting the second magnetic signal to the microcontroller 14, and the microcontroller 14 simultaneously receiving the first magnetic signal and the second magnetic signal, the microcontroller 14 controlling the touch switch 8 to transmit the first switch signal or the second switch signal, and the touch control assembly 4 capable of turning on or off.

When the first valve body 3 is closed and the fixed cylinder 13 is drawn out, the spring 51 naturally expanding, the magnet 52 being located closest to the first magnetic probe 53, and the first magnetic probe 53 detecting the first magnetic signal and transmitting to the microcontroller 14, the soft magnet 61 being located far away from the initial position, the second magnetic probe 62 detecting a third magnetic signal and transmitting the third magnetic signal to the microcontroller, and the microcontroller 14 simultaneously receiving the first magnetic signal and the third magnetic signal, the microcontroller 14 controlling the touch switch 8 to not transmit the first switch signal and the second switch signal, and the touch control assembly 4 being normally closed.

When the mixing valve is opened and the fixed cylinder 13 is not drawn out, the tap water in the connecting pipe 213 to the outer waterway 122 flowing due to the pressure difference, the spring 51 being compressed, the magnet 52 being located away from the first magnetic probe 53, and the first magnetic probe 53 detecting a fourth magnetic signal and transmitting to the microcontroller 14, the soft magnet 61 being located the initial position, the second magnetic probe 62 detecting the second magnetic signal and transmitting to the microcontroller 14, and the microcontroller 14 simultaneously receiving the fourth magnetic signal and the second magnetic signal, the microcontroller 14 controlling the touch switch 8 to not transmit the first switch signal and the second switch signal, and the touch control assembly 4 being normally closed.

When the mixing valve is opened and the fixed cylinder 13 is drawn out, the tap water in the connecting pipe 213 to the outer waterway 122 flowing due to the pressure difference, the spring 51 being compressed by the water flow pressure, the magnet 52 being located away from the first magnetic probe 53, and the first magnetic probe 53 detecting the fourth magnetic signal and transmitting to the microcontroller 14, the soft magnet 61 being located away from the initial position, the second magnetic probe 62 detecting the third magnetic signal and transmitting to the microcontroller 14, and the microcontroller 14 simultaneously receiving the fourth magnetic signal and the third magnetic signal, the microcontroller 14 controlling the touch switch 8 to not transmit the first switch signal and the second switch signal, and the touch control assembly 4 being normally closed.

In the course of using, when tap water is turned on or the pulling head 11 is pulled out, the touch switch 8 is inadvertently pressed and the hot purified water flows out to easily burn the user. The first magnetic component and the second magnetic component are used in the above technical solution, as long as the first valve body 3 is open, or as long as the fixed cylinder 13 is pulled out, the purified water switches are closed and can not be opened, thereby achieving the purpose of preventing burns.

In another technical solution, the second pipeline 22 is a silicone pipe, silicone rubber being a new type of polymer elastic material with excellent high temperature resistance (250-300 degree Celsius) and low temperature resistance (−40-60 degree Celsius) performance, good physical stability, and capable of withstanding repeated harsh and disinfection conditions, having excellent resilience and low permanent deformation, being most suitable for conveying cold or hot purified water.

In another technical solution, the connecting pipe 213 is provided with a counterweight 214 on the outer wall of the upstream end along the water flow direction, so that the first pipeline 21 and the second pipeline 22 in the casing pipe 1 are returned to the original position because of the gravitational action of the counterweight 214 after the fixed cylinder 13 is put back the casing pipe 1, preventing the first pipeline 21 and the second pipeline 22 from bending and folding in the casing pipe 1.

In another technical solution, the casing pipe is a bending pipe so that the water outlet of the casing pipe 1 faces downward for easy connection of the tap water and the purified water.

In another technical solution, the device integrated hot and cold tap water and hot and cold purified water also comprises a water saving mechanism 7, comprising: a first electric valve 71 provided on the connecting pipe 213; an intercepting pipe 72, one end of which is inserted into the outer wall of the connecting pipe 213 and communicated with the connecting pipe 213, and the intercepting pipe 72 being provided with a second electric valve 73; a water collecting tank 74 with a top communicating with the other end of the intercepting pipe 72; a water outlet pipe body 75, one end of which is communicated with the bottom of the water collecting tank 74, and the other end of which is inserted into the outer wall of the first water inlet hose 211 and communicated with the first water inlet hose 211, and the water outlet pipe body 75 being provided with a third electric valve 76; a fourth electric valve 77 disposed on the first water inlet hose 211 and located at an upstream position of communicating place of the water outlet pipe body 75 and the first water inlet hose 211 along the water flow direction; a temperature sensor 2131 disposed on the connecting pipe 213 to detect the water temperature in the connecting pipe 213; a water level sensor 78 disposed on the water collecting tank 74 to detect a water level in the water collecting tank 74.

Wherein the temperature sensor 2131, the water level sensor 78, the first electric valve 71, the second electric valve 73, the third electric valve 76, and the fourth electric valve 77 are all electrically connected with the microcontroller 14; the water level sensor 78 detecting the water level in the water collecting tank 74 at a preset frequency, and if the water level is lower than a first water level threshold, the microcontroller 14 controlling to turn off the third electric valve 76 and simultaneously turn on the fourth electric valve 77, if the water level is higher than a second water level threshold, the microcontroller 14 controlling to turn on the third electric valve 76 while turning off the fourth electric valve 77, wherein the first water level threshold is smaller than the second water level threshold.

When the first valve body 3 is opened, the microcontroller 14 controlling the temperature sensor 2131 to detect the water temperature in the connecting pipe 213 at a preset frequency, and when the water temperature is higher than a preset temperature threshold, the microcontroller 14 controlling to turn on the first electric valve 71 while turning off the second electric valve 73.

When the first valve body 3 is closed, the microcontroller 14 controlling the temperature sensor 2131 and the water level sensor 78 to stop detecting while turning off the first electric valve 71 and turning on the second electric valve 73.

In the course of using, if the hot water supply part 19 of the tap water supply part is farther away from the water outlet of the casing pipe 1, it will need to pass through a longer pipeline to reach the water outlet of the casing pipe 1, thus requiring to collect a large quantity of cold tap water in the first pipeline 21 in order to receive hot tap water. It will waste a lot of tap water resources, in the above technical solution. The cold tap water in the first pipeline 21 is introduced into the collecting tank 74 for temporarily storing through the intercepting pipe 72. When the cold tap water is completely intercepted, stopping intercepting, so that the water from the water outlet pipe of the casing pipe 1 is hot.

When the amount of tap water in the water collecting tank 74 reaches a certain amount, cold tap water needs to be used, flowing back to the first pipeline 21 through the water outlet pipe body 75, and then flowing out from the water outlet of the casing pipe 1 to achieve the purpose of saving water.

In another technical solution, the preset frequency of the water level sensor 78 for detecting the water level is 10 times/min so as to prevent the water level in the water collecting tank 74 from exceeding the volume of the water collecting tank 74 and lose water saving effect.

In another technical solution, the preset frequency of the temperature sensor 2131 for detecting the water temperature is 30 times/min to prevent a large amount of hot tap water from flowing to the water collecting tank 74 through the intercepting pipe 72, thus causing the heat energy loss of the hot tap water.

In another technical solution, the preset temperature threshold is set to 42 degrees Celsius, the tap water temperature being the most comfortable when it is slightly above the human thermal insulation temperature and therefore being set to 42 degrees Celsius.

In another technical solution, the water collecting tank 74 is transparent, the side wall of the water collecting tank is provided with a scale, the volume of the water collecting tank 74 is 5 L, and the water level in the water collecting tank 74 can be visually observed.

Although the embodiments of the present invention have been disclosed above, they are not limited to the applications previously mentioned in the specification and embodiments, and can be applied in various fields suitable for the present invention. For ordinary skilled person in the field, other various changed model, formula and parameter may be easily achieved without creative work according to instruction of the present invention, changed, modified and replaced embodiments without departing the general concept defined by the claims and their equivalent are still included in the present invention. The present invention is not limited to particular details and illustrations shown and described herein.

What is claimed is:

1. A device integrated hot and cold tap water and hot and cold purified water, comprising:

a casing pipe;

a water guide mechanism including a first pipeline and a second pipeline disposed in the casing pipe, the first pipeline having one end in communication with a water outlet of the casing pipe and an opposing end in communication with a tap water supply part, the second pipeline having one end in communication with the water outlet of the casing pipe and an opposing end in communication with a purified water supply part, and the first pipeline and the second pipeline being respectively provided with a first valve body and a touch control assembly, wherein the first valve body is a mixing valve;

a touch switch electrically connected with the touch control assembly;

a microcontroller electrically connected with the touch control assembly;

a pulling head comprising a fixed cylinder provided in the water outlet of the casing pipe and a bubble former fixed in the fixed cylinder, an interior of the bubble former having an inner waterway and an outer waterway sleeved outside the inner waterway, and the inner waterway being not communicated with the outer waterway, the inner waterway and one end of the outer waterway being communicated with the water outlet of the casing pipe, wherein the first pipeline and the second pipeline communicate with the water outlet of the casing pipe through the outer waterway and one end of the inner waterway, respectively, and the first pipeline and the second pipeline extending out of the water outlet of the casing pipe along a downstream end along a water flow direction when the fixed cylinder is pulled out of the casing pipe, wherein the first pipeline comprises: a first water inlet hose having one end communicated with a cold water supply part of the tap water supply part and the other end communicated with a water inlet end of the first valve body; a second water inlet hose having one end communicated with a hot water supply part of the tab water supply art and the other end communicated with the water inlet end of the first valve body; and a connecting pipe having one end communicated with the water outlet end of the first valve body and the other end communicated with the outer waterway, wherein the second pipeline is a flexible pipe, the opposing end of the second pipeline is provided with two branch pipes, the two branch pipes are respectively communicated with a hot water supply part and a cold water supply part of the purified water supply part, and the two branch pipes are provided with a hot water valve and a cold water valve;

a first magnetic component comprising: a spring installed inside of the connecting pipe along the water flow direction and located outside of the second pipeline and fixed along the downstream end along the water flow direction; a magnet fixed to an upstream end of the spring along the water flow direction, the magnet being located inside of the connecting pipe and located outside of the second pipeline; and a first magnetic probe fixed outside of the connecting pipe and located at an upstream position of the magnet along the water flow direction to detect a magnetic force signal of the magnet, the first magnetic probe being electrically connected with the microcontroller;

a second magnetic component comprising: a soft magnet wrapped on an outer wall of the connecting pipe; and a second magnetic probe disposed on the inner wall of the casing pipe and located at an upstream position of the soft magnet along the water flow direction to detect a magnetic force signal of the soft magnet and the second magnetic probe being electrically connected with the microcontroller, when the first valve body being the mixing valve is closed and the fixed cylinder is not drawn out, the spring naturally expanding, the magnet being located closest to the first magnetic probe, and the first magnetic probe detecting a first magnetic signal and transmitting to the microcontroller, the soft magnet being located at an initial position, the second magnetic probe detecting a second magnetic signal and transmitting the second magnetic signal to the microcontroller, and the microcontroller simultaneously receiving the first magnetic signal and the second magnetic signal, the microcontroller controlling the touch switch to transmit the first switch signal or the second switch signal, and the touch control assembly capable of turning on or off;

when first valve body being the mixing valve is closed and the fixed cylinder is drawn out, the spring naturally expanding, the magnet being located closest to the first magnetic probe, and the first magnetic probe detecting the first magnetic signal and transmitting to the microcontroller, the soft magnet being located far away from the initial position, the second magnetic probe detecting a third magnetic signal and transmitting the third magnetic signal to the microcontroller, and the microcontroller simultaneously receiving the first magnetic signal and the third magnetic signal, the microcontroller controlling the touch switch to not transmit the first switch signal and the second switch signal, and the touch control assembly being normally closed;

when the first valve body being the mixing valve is opened and the fixed cylinder is not drawn out, the spring being compressed, the magnet being located away from the first magnetic probe, and the first magnetic probe detecting a fourth magnetic signal and transmitting to the microcontroller, the soft magnet being located the initial position, the second magnetic probe detecting the second magnetic signal and transmitting to the microcontroller, and the microcontroller simultaneously receiving the fourth magnetic signal and the second magnetic signal, the microcontroller controlling the touch switch to not transmit the first switch signal and the second switch signal, and the touch control assembly being normally closed; and when the first valve body being the mixing valve is opened and the fixed cylinder is drawn out, the spring being compressed, the magnet being located away from the first magnetic probe, and the first magnetic probe detecting the fourth magnetic signal and transmitting to the microcontroller, the soft magnet being located away from the initial position, the second magnetic probe detecting the third magnetic signal and transmitting to the microcontroller, and the microcontroller simultaneously receiving the fourth magnetic signal and the third magnetic signal, the microcontroller controlling the touch switch to not transmit the first switch signal and the second switch signal, and the touch control assembly being normally closed.

2. The device integrated hot and cold tap water and hot and cold purified water according to claim 1, wherein the outer diameter of a downstream end of the fixed cylinder along the water flow direction is not smaller than the outer diameter of the water outlet of the casing pipe, and the inner diameter is smaller than the inner diameter of the water outlet of the casing pipe.

3. The device integrated hot and cold tap water and hot and cold purified water according to claim 1, wherein the fixed cylinder, the inner waterway, and the outer waterway are coaxially arranged, and the one end of the second pipeline penetrates into the first pipeline, communicates with the inner waterway and finally communicates with the water outlet of the casing pipe.

4. The device integrated hot and cold tap water and hot and cold purified water according to claim 1, wherein the second pipeline is a silicone pipe.

5. The device integrated hot and cold tap water and hot and cold purified water according to claim 1, wherein the outer wall of an upstream end of the connecting pipe along the water flow direction is provided with a counterweight.

6. The device integrated hot and cold tap water and hot and cold purified water according to claim 1, wherein the casing pipe is a bending pipe.

7. The device integrated hot and cold tap water and hot and cold purified water according to claim 1, also comprising a water saving mechanism, comprising:

a first electric valve provided on the connecting pipe;

an intercepting pipe, one end of which is inserted into the outer wall of the connecting pipe and is communicated with the connecting pipe, and the intercepting pipe being provided with a second electric valve;

a water collecting tank with a top communicating with the other end of the intercepting pipe;

a water outlet pipe body, one end of which is communicated with the bottom of the water collecting tank, and the other end of which is inserted into the outer wall of the first water inlet hose and communicated with the first water inlet hose, and the water outlet pipe body being provided with a third electric valve;

a fourth electric valve disposed on the first water inlet hose and located at an upstream position of communicating place of the water outlet pipe body and the first water inlet hose along the water flow direction;

a temperature sensor disposed on the connecting pipe to detect a water temperature in the connecting pipe; and a water level sensor disposed on the water collecting tank to detect a water level in the water collecting tank;

wherein the temperature sensor, the water level sensor, the first electric valve, the second electric valve, the third electric valve, and the fourth electric valve are all electrically connected with the microcontroller;

the water level sensor detecting the water level in the water collecting tank at a preset frequency, and if the water level is lower than a first water level threshold, the microcontroller controlling to turn off the third electric valve and simultaneously turn on the fourth electric valve, if the water level is higher than a second water level threshold, the microcontroller controlling to turn on the third electric valve while turning off the fourth electric valve, wherein the first water level threshold is smaller than the second water level threshold;

when the first valve body is opened, the microcontroller controlling the temperature sensor to detect the water temperature in the connecting pipe at a preset frequency, and when the water temperature is higher than a preset temperature threshold, the microcontroller controlling to turn on the first electric valve while turning off the second electric valve; and when the first valve body is closed, the microcontroller controlling the temperature sensor and the water level sensor to stop detecting while turning off the first electric valve and turning on the second electric valve.

8. The device integrated hot and cold tap water and hot and cold purified water according to claim 7, wherein the preset frequency of the water level sensor for detecting the water level is 10 times/min.

9. The device integrated hot and cold tap water and hot and cold purified water according to claim 7, wherein the preset frequency of the temperature sensor for detecting the water temperature is 30 times/min.

10. The device integrated hot and cold tap water and hot and cold purified water according to claim 7, wherein the preset temperature threshold is set to 42 degrees Celsius.

11. The device integrated hot and cold tap water and hot and cold purified water according to claim 7, wherein the water collecting tank is transparent, a side wall of the water collecting tank is provided with a scale, and the volume of the water collecting tank is 5 L.

* * * * *